US007735328B2

(12) United States Patent
Kim et al.

(10) Patent No.: US 7,735,328 B2
(45) Date of Patent: Jun. 15, 2010

(54) APPARATUS AND METHOD FOR MONITORING STATE INFORMATION IN TRIAL RUN MODE OF MULTI-AIRCONDITIONER

(75) Inventors: Kwang Woon Kim, Seoul (KR); Se Dong Chang, Gwangmyeong-si (KR); Baik Young Chung, Incheon-si (KR); Jeong Eon Oh, Seoul (KR)

(73) Assignee: LG Electronics Inc., Seoul (KR)

( * ) Notice: Subject to any disclaimer, the term of this patent is extended or adjusted under 35 U.S.C. 154(b) by 730 days.

(21) Appl. No.: 11/249,432

(22) Filed: Oct. 14, 2005

(65) Prior Publication Data

US 2006/0123808 A1 Jun. 15, 2006

(30) Foreign Application Priority Data

Dec. 9, 2004 (KR) ..... 10-2004-0103481

(51) Int. Cl.
*F25B 49/00* (2006.01)
*G05D 23/00* (2006.01)

(52) U.S. Cl. ..... 62/127; 62/129; 62/199; 236/51

(58) Field of Classification Search ..... 62/125, 62/127, 129, 199, 200; 236/51; 700/276
See application file for complete search history.

(56) References Cited

U.S. PATENT DOCUMENTS 5,743,101 A 4/1998 Shida et al.
5,853,123 A * 12/1998 Okano et al. ..... 236/51
5,974,813 A 11/1999 Jeong
6,978,627 B2 * 12/2005 Masui et al. ..... 62/127
2003/0140637 A1 7/2003 Masui et al.
2005/0061008 A1 * 3/2005 Ben-Nakhi et al. ..... 62/127
2005/0159847 A1 * 7/2005 Shah et al. ..... 700/276

FOREIGN PATENT DOCUMENTS

EP 1 426 703 A1 6/2004
EP 1666805 6/2006
JP 9-137988 A 5/1997
KR 1020040098756 11/2004

* cited by examiner

*Primary Examiner*—Marc E Norman
(74) *Attorney, Agent, or Firm*—Birch, Stewart, Kolasch & Birch, LLP

(57) ABSTRACT

An apparatus and method for monitoring state information in a trial run mode of a multi-airconditioning system in which a plurality of indoor units are controlled by only one outdoor unit is disclosed. The apparatus and method connects a dedicated controller to the outdoor unit in a trial run mode of the multi-airconditioning system, such that it controls the indoor units and monitors state information of the indoor and outdoor units. The apparatus includes a trial-run-mode controller and a control input & state display unit. The trial-run-mode controller connected to the outdoor unit includes a trial-run-mode program for automatically detecting poor installation of the multi-airconditioning system. The control input & state display unit is connected to the trial-run-mode controller, enters control signals capable of performing control and monitoring operations of the trial run mode executed after the multi-airconditioning system has been installed, and outputs information associated with the control signals.

5 Claims, 8 Drawing Sheets

APPARATUS AND METHOD FOR MONITORING STATE INFORMATION IN TRIAL RUN MODE OF MULTI-AIRCONDITIONER

This application claims the benefit of Korean Patent Application No. P 2004-00103481, filed on Dec. 9, 2004, which is hereby incorporated by reference as if fully set forth herein.

BACKGROUND OF THE INVENTION

1. Field of the Invention

The present invention relates to a multi-airconditioner for controlling a plurality of indoor units using only one outdoor unit, and more particularly, to an apparatus and method for monitoring state information in a trial run mode, which connects a dedicated controller to the outdoor unit in a trial run mode, such that it controls the indoor units and monitors state information of the indoor units and the outdoor unit.

2. Discussion of the Related Art

Generally, airconditioners are classified into a multi-airconditioner which includes a plurality of indoor units, each of which is installed in individual rooms, and a single outdoor unit connected to the indoor units; a separated-type airconditioner composed of an indoor unit and an outdoor unit, and an integrated-type airconditioner in which the outdoor unit and the indoor unit are integrated in one body.

The multi-airconditioner has been designed to connect a plurality of indoor units to a single outdoor unit. Generally, a single outdoor unit is installed at the outside, and a plurality of indoor units are installed into individual rooms to be cooled, such that the above-mentioned multi-airconditioner provides individual rooms with cool air.

As described above, the above-mentioned multi-airconditioner connects a plurality of indoor units in parallel to only one outdoor unit, such that a central microprocessor (e.g., a CPU) of the multi-airconditioner cools individual rooms including the indoor units via a communication line according to a multi-airconditioning scheme. Since the multi-airconditioner has a complicated wiring structure due to unique operation characteristics thereof, a user or operator must pay great attention to a wiring connection and pipe arrangement between the outdoor unit and the indoor units when the multi-airconditioner is initially installed at a desired location.

FIG. 1 shows a structural diagram illustrating a conventional multi-airconditioning system.

Referring to FIG. 1, the conventional multi-airconditioning system includes a plurality of indoor units 14*a*, 14*b*, and 14*c* installed in individual rooms to cool multiple areas; a plurality of controllers 15*a*, 15*b*, and 15*c* for controlling individual operations of the indoor units 14*a*~14*c*; a central controller 12 and a high-class central controller 13 for controlling operations of the multi-airconditioning system; and an outdoor unit 13 connected to the indoor units 14*a*~14*c* via a communication line and a pipe line.

The above-mentioned multi-airconditioning system compresses a refrigerant using individual inner compressors of the indoor units 14*a*~14*c*, liquefies the compressed refrigerant using a condenser, transmits the liquefied refrigerant to an inner evaporator of the outdoor unit 11 via an expansion valve, and controls the inner evaporator of the outdoor unit 11 to vaporize the refrigerant, and generates vaporization heat, such that it cools rooms using the vaporization heat.

The above-mentioned operations are controlled by control values of a variety of sensors contained in the indoor units 14*a*~14*c* and the outdoor unit 11, or a variety of operation variable values.

If the multi-airconditioning system is installed as described above, a user or operator controls the multi-airconditioning system to enter a trial run mode to determine whether the multi-airconditioning system is normally installed.

During the trial run mode, the multi-airconditioning system operates the indoor units 14*a*~14*c* connected to the outdoor unit 11, and determines whether cooling/heating airconditioning functions are normally operated.

Two methods have been widely used to operate the indoor units 14*a*~14*c*. Firstly, the multi-airconditioning system operates individual controllers 15*a*~15*c* connected to individual indoor units 14*a*~14*c* to perform the trial run mode. Secondly, the multi-airconditioning system operates the central controller 12 and the high-class central controller 13 installed in a predetermined management room.

In the case of the above-mentioned trial run mode, a user or operator installs the outdoor unit at a specific place located at the outside of a predetermined building, enters the building to perform the trial run mode, operates the indoor units, recognizes operation state information of individual indoor units, goes to the specific place including the outdoor unit, and finally inspects operations of the outdoor unit.

Therefore, the above-mentioned conventional method for performing the trial run mode of the multi-airconditioning system allows the user or operator to suffer unexpected troubles and inconvenience in the trial run mode.

Also, the above-mentioned conventional method can recognize only operation state information of the multi-airconditioning system, such that it cannot correctly recognize not only a pipe arrangement state between the outdoor unit and the indoor units, but also cooling/heating control operations of the outdoor and indoor units.

If there arises variation in operation state information due to installation position information (e.g., high or low installation position) of the indoor and outdoor units and seasonal factors of installation time, the above-mentioned conventional method may cause the user or operator to suffer many problems in correctly recognizing the changed operation state information.

SUMMARY OF THE INVENTION

Accordingly, the present invention is directed to an apparatus and method for monitoring state information in a trial run mode of a multi-airconditioner that substantially obviates one or more problems due to limitations and disadvantages of the related art.

An object of the present invention is to provide an apparatus and method for monitoring state information in a trial run mode of a multi-conditioner capable of controlling a plurality of indoor units using only one outdoor unit, which connects a dedicated controller to the outdoor unit in a trial run mode of the multi-airconditioner, such that it controls the indoor units and monitors state information of the indoor units and the outdoor unit.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an apparatus for monitoring state information in a trial run mode of a multi-airconditioning system in which a plurality of indoor units are connected to an outdoor unit, comprises: a trial-run-mode controller for automatically detecting poor installation of the multi-airconditioning system, controlling individual on/off operations of the indoor units at a remote site, and detecting temperature information of individual pipes contained in the outdoor unit and a device state of the outdoor unit; and a control input & state display unit which is connected to the trial-run-mode controller, enters control signals capable of performing control and monitoring operations of the trial run mode executed after the multi-airconditioning system has been installed, and outputs information associated with the control signals.

Preferably, the trial-run-mode controller includes: a microprocessor for controlling the indoor and outdoor units, and monitoring the indoor and outdoor units; an outdoor-unit connector connected to the outdoor unit; and a computer connector connected to a computer acting as a terminal capable of entering the control signals and displaying operation states.

Preferably, the outdoor unit is connected to a communication module connected to the trial-run-mode controller via the outdoor-unit connector, such that the communication module communicates with the trial-run-mode controller to control operations of the trial run mode and to display operation states of the outdoor unit.

In another aspect of the present invention, there is provided a method for monitoring state information in a trial run mode of a multi-airconditioning system in which a plurality of indoor units are connected to an outdoor unit, comprising the steps of: a) connecting a trial-run-mode controller to the outdoor unit when the multi-airconditioning system is installed, and performing a trial-run-mode program; b) initiating the trial run mode, controlling individual operations of the indoor and outdoor units, monitoring operation states of the indoor and outdoor units, and automatically detecting poor installation of the multi-airconditioning system; and c) displaying information indicating whether the multi-airconditioning system is normally installed, whereby installation and operation states of the multi-airconditioning system are monitored.

Preferably, the trial-run-mode program includes a predetermined item capable of selecting the trial run mode or an indoor-unit control mode in a program execution screen image.

Preferably, if the trial run mode is selected, the predetermined item includes a selection window for initiating/interrupting the trial run mode, a temperature/pressure confirmation window for displaying temperature and pressure information such as a compressor discharge pipe temperature, and a display window for displaying operation states of individual units.

Preferably, the program execution screen image where a user or operator selects the indoor-unit control mode to recognize operation states of the indoor units includes: an indoor-unit selection window for selecting/releasing all the indoor units, or selecting individual indoor units independently of each other; an operation/stop selection window of the selected indoor units; an operation mode/ventilation mode selection window; and a selection window for setting a desired temperature, whereby individual on/off control operations of the indoor units are performed.

Preferably, the monitoring resultant value associated with the installation and operation states of the multi-airconditioning system includes temperatures of individual pipes contained in the outdoor unit, device state information, and airconditioning cycle information.

Preferably, the method comprises the step of: d) if the multi-airconditioning system is abnormally installed, displaying detailed information of the abnormal installation part on the screen.

Preferably, the method further comprises the step of: e) if the multi-airconditioning system is abnormally installed, repeating the state monitoring operation and a poor installation detection operation.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

An apparatus and method for monitoring state information in a trial run mode of a multi-airconditioner will hereinafter be described with reference to the annexed drawings.

Figure 2:
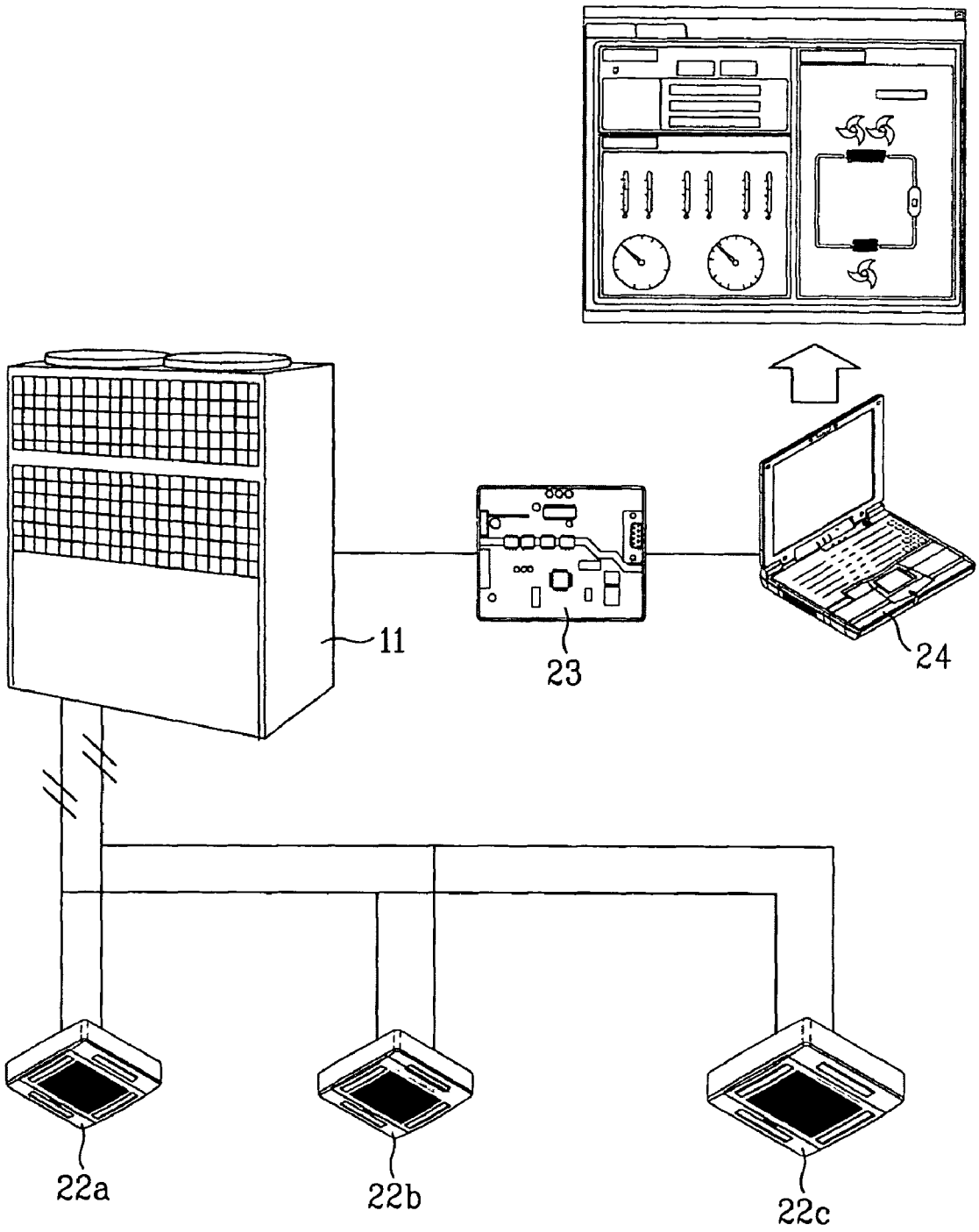
FIG. 2 shows a structural diagram illustrating a multi-airconditioning system including a controller for a trial run mode in accordance with the present invention.
Figure 3:
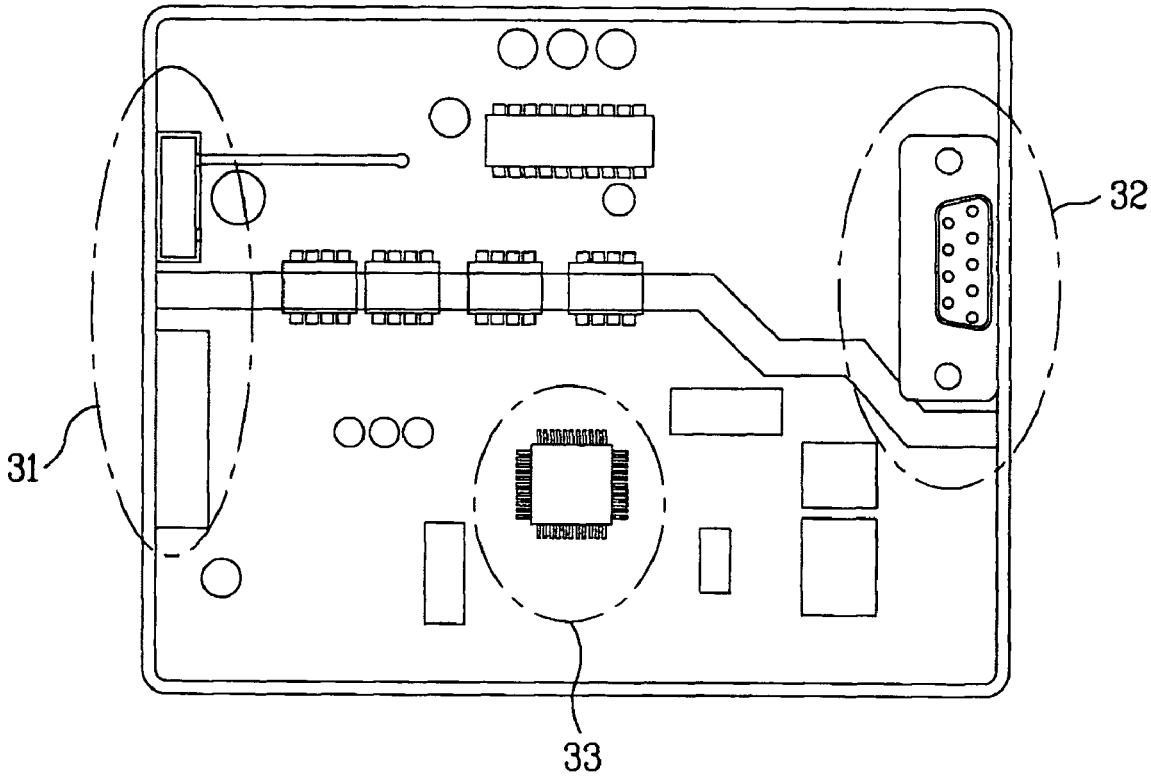
FIG. 3 shows a structural diagram illustrating the controller for the trial run mode in accordance with the present invention.

FIG. 2 shows a structural diagram illustrating a multi-airconditioning system including a controller for a trial run mode in accordance with the present invention. FIG. 3 shows a structural diagram illustrating the controller for the trial run mode in accordance with the present invention.

The multi-airconditioning system according to the present invention enables a user or operator to suffer less inconvenience during the trial run mode executed after the multi-airconditioner is initially installed, recognizes visual operation states of the multi-airconditioner and correct pipe arrangement state information of the outdoor and indoor units, and also recognizes correct cooling/heating control information.

The multi-airconditioning system according to the present invention connects a controller for use in a trial run mode (hereinafter referred to as a trial-run-mode controller) to an outdoor unit. The trial-run-mode controller recognizes a pipe arrangement state, controls cooling/heating operations, and controls operations of indoor units at the outside, such that it controls and monitors the multi-airconditioning system, differently from the conventional trial run mode execution method in which a user or operator has installed an outdoor unit at a specific place located at the outside of a predetermined building, has entered the building to perform the trial run mode, operates the indoor units, has recognized operation state information of individual indoor units, has gone to the specific place including the outdoor unit, and has finally inspected operations of the outdoor unit.

Therefore, the above-mentioned multi-airconditioning system according to the present invention minimizes inconvenience of the user or operator in a trial run mode, and increases convenience of the user or operator and accuracy of the trial run mode.

As shown in FIG. 2, the multi-airconditioning system according to the present invention includes a plurality of indoor units 22*a*, 22*b*, and 22*c* installed in individual rooms to cool different areas; an outdoor unit 21 connected to the indoor units 22*a*~22*c* via a communication line and a pipe line; a trial-run-mode controller 23 connected to the outdoor unit 21, for automatically detecting poor installation of the multi-aircontioner, controlling individual ON/OFF operations of the indoor units 22*a*~22*c* at the outside, checking operation states of the indoor units 22*a*~22*c* at the outside, and recognizing temperature information of individual pipes contained in the outdoor unit 21 and state information thereof; and a control input & state display 24 connected to the trial-run-mode controller 23, for entering control signals capable of controlling/monitoring a trial run mode executed after the multi-airconditioner has been installed, and displaying information associated with the control signals.

Figure 1:
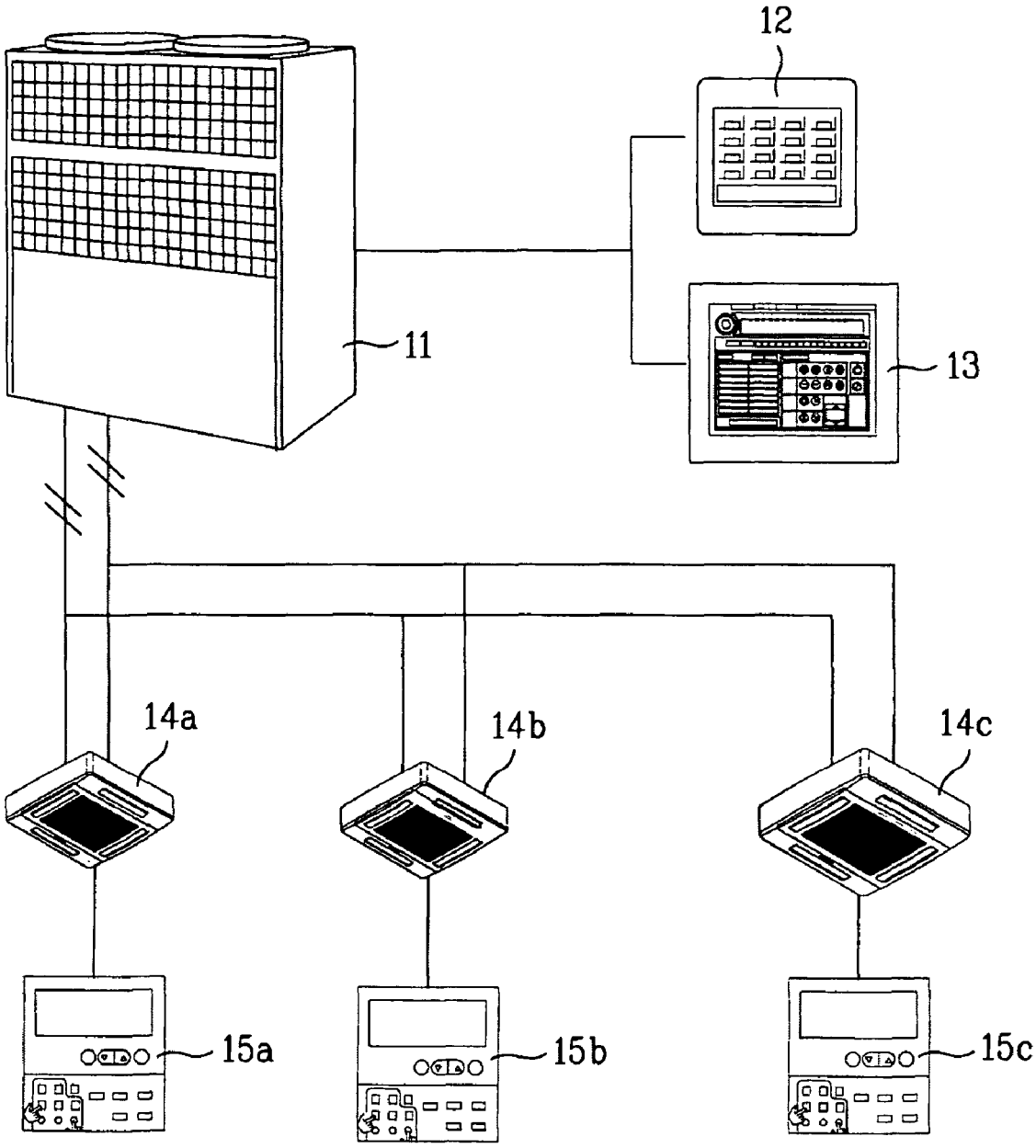
FIG. 1 Prior Art
FIG. 1 shows a structural diagram illustrating a conventional multi-airconditioning system.

In this case, the trial-run-mode controller 23 and the control input & state display 24 are adapted to monitor operations of the trial run mode of the multi-airconditioning system, and are different from the central controller 12 and the high-class central controller 13 for controlling the conventional multi-airconditioning system shown in FIG. 1.

The trial-run-mode controller 23 and the control input & state display 24 are not installed in a management room in the same manner as in the central controller 12 and the high-class central controller 13, and are connected to the outdoor unit 21 as necessary.

In more detail, as shown in FIG. 3, the trial-run-mode controller 23 includes a microprocessor 33 for controlling/monitoring the indoor units and the outdoor unit; a first connector 31 (hereinafter referred to as an outdoor-unit connector) connected to the outdoor unit of the multi-airconditioner; and a second connector 32 (hereinafter referred to as a computer connector) which is connected to a computer acting as a terminal unit capable of entering control signals and displaying operation states, and performs RS232 serial communication.

The microprocessor 33 of the trial-run-mode controller 23 includes a program for connecting the outdoor unit to the computer via the connectors.

The outdoor unit 21 is connected to the trial-run-mode controller 23 via the outdoor-unit connector 31, and includes a communication module capable of controlling operations of the trial run mode and displaying operation states thereof.

The trial-run-mode controller 23 stores operation variable values of the multi-airconditioning system, stores abnormal installation information, and outputs the operation variable values and the abnormal installation information.

Needless to say, the above-mentioned information is not stored in the trial-run-mode controller 23 to systemically manage customers, and may be stored in a specific computer connected via the computer connector 32 as necessary.

By the above-mentioned information storage operations, only information selected by a user or operator may be stored in the computer, or may not be stored in the computer as necessary.

In order to allow the user or operator to use the trial-run-mode controller of FIG. 3 as a dedicated terminal, a control signal input unit and a state information display are added to the trial-run-mode controller, such that they can be implemented with an integrated terminal.

If the integrated terminal is configured as described above, only the outdoor-unit connector connected to the outdoor unit is configured, other control input & state displays (e.g., the computer connector connected to the computer) are not included in the integrated terminal.

The trial-run-mode controller including a control/monitoring program. The trial-run-mode controller can automatically detect poor installation of the multi-airconditioner, can control individual ON/OFF operations of indoor units at the outside, can recognize operation states of the indoor units at the outside, can recognize temperature information of individual pipes contained in an outdoor unit, and state information of the outdoor unit, and can display airconditioning cycle information using the control/monitoring program. The trial-run-mode is not always used for only the trial run mode, and may be used by A/S (After-sale service) staffs who receive faulty operation information from a user of the multi-airconditioner, such that it diagnoses and repairs the faulty operation.

The trial-run-mode program includes three functions. According to the first function, the trial-run-mode program automatically detects the occurrence of poor installation. According to the second function, the trial-run-mode program switches on or off individual indoor units, and recognizes operation state information of the indoor units. According to the third function, the trial-run-mode program displays temperature information of individual pipes contained in the outdoor unit, device state information, and airconditioning cycle information, etc.

The above-mentioned trial-run-mode program is stored in a microprocessor of the trial-run-mode controller 23, or is stored in the computer acting as the control input & state display 24.

Otherwise, the program for monitoring state information of the trial run mode is installed in the trial-run-mode controller 23. A viewer program for displaying resultant values on a screen when a state monitoring operation is performed by the trial-run-mode controller 23 may be installed in the computer as necessary.

The above-mentioned device (hereinafter referred to as a state monitoring device) for monitoring state information in a trial run mode of the multi-airconditioner may allow a user or operator to suffer less inconvenience when the user or operator operates a remote-controller connected to indoor units.

The state monitoring device controls all the indoor units at a specific location at which the outdoor unit is installed, and includes a trial-run-mode controller arranged between the outdoor unit and the computer to recognize operation states of the indoor units and the outdoor unit, such that it recognizes temperature information of individual pipes contained in the outdoor unit, device state information, and airconditioning cycle information, resulting in increased accuracy of the trial run mode.

A monitoring control method using the state monitoring apparatus in a trial run mode of the multi-airconditioner will hereinafter be described in detail.

Figure 4:
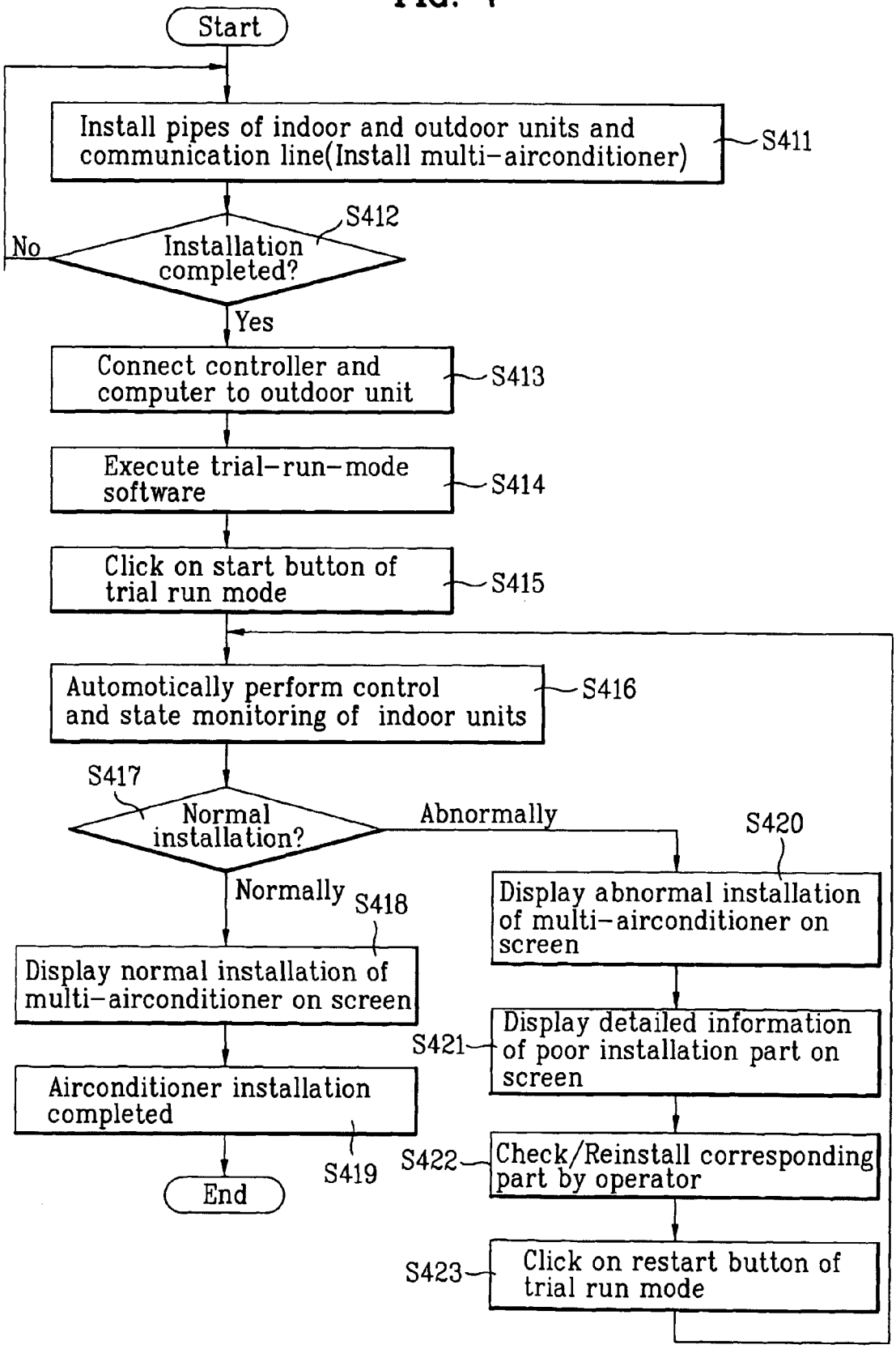
FIG. 4 is a flow chart illustrating a method for monitoring state information in a trial run mode of a multi-airconditioner in accordance with the present invention.
Figure 5A:
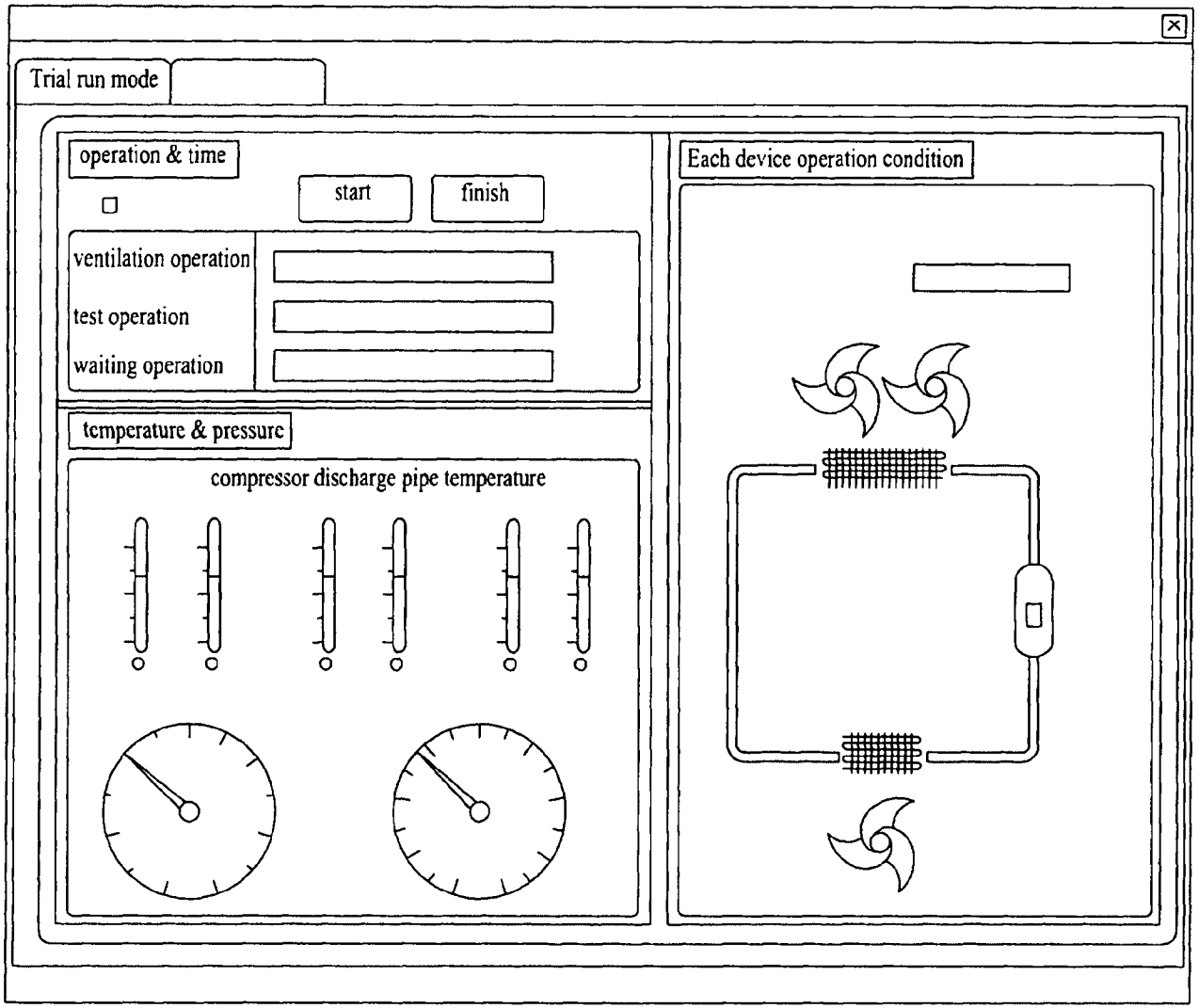
FIGS. 5*a*~5*d* show exemplary output images displayed by state monitoring operations of the trial run mode in accordance with the present invention.
Figure 5B:
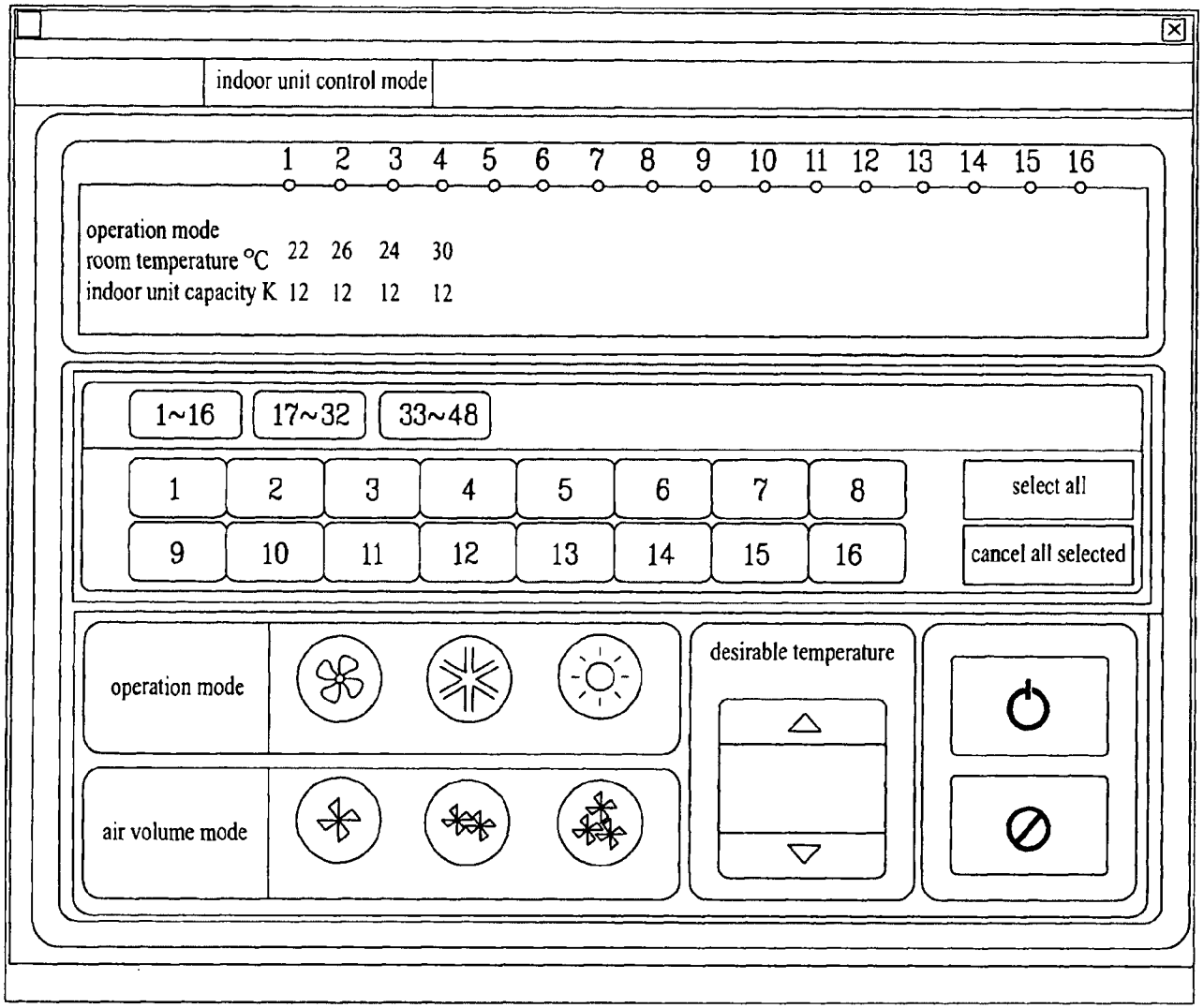
Figure 5C:
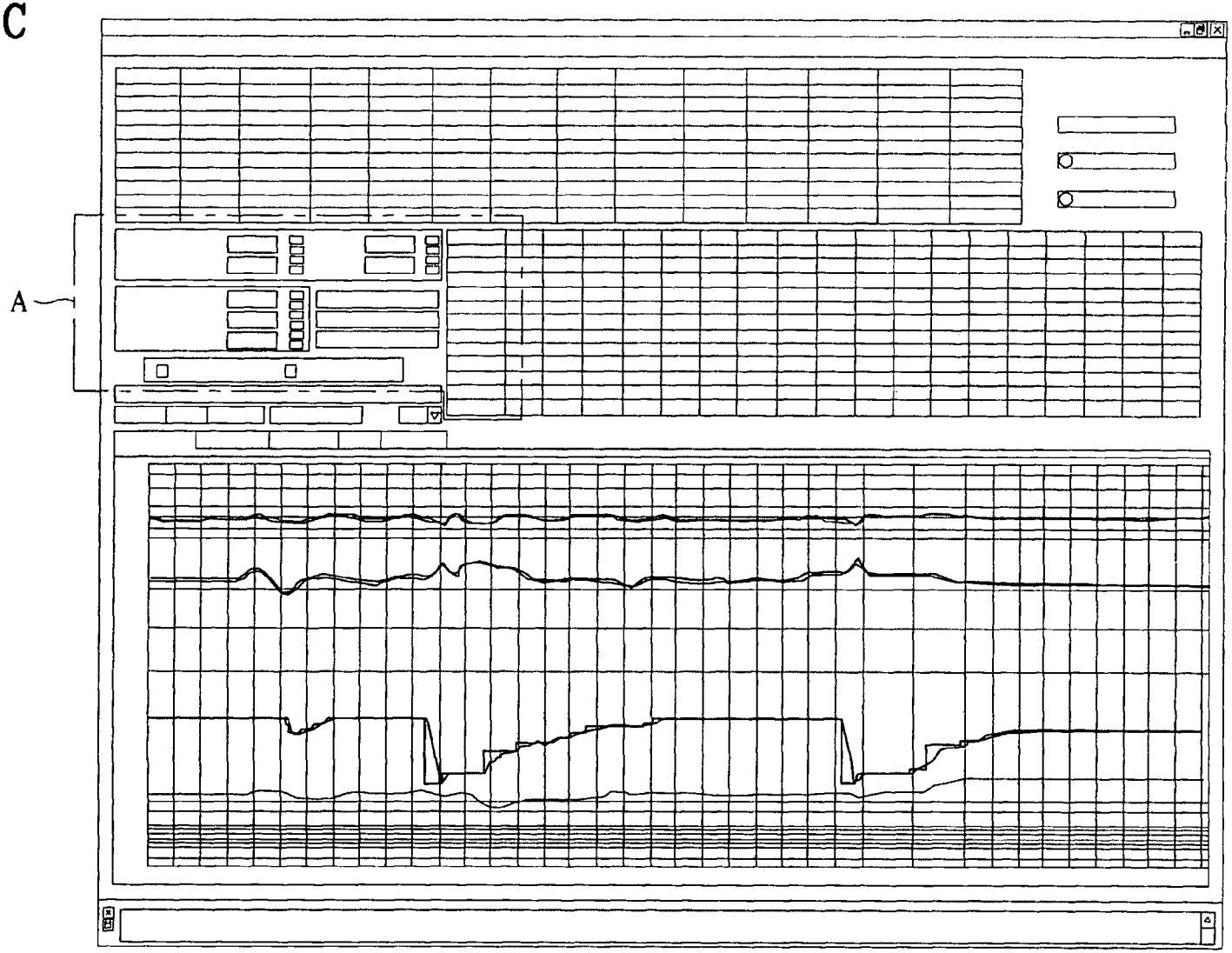
Figure 5D:
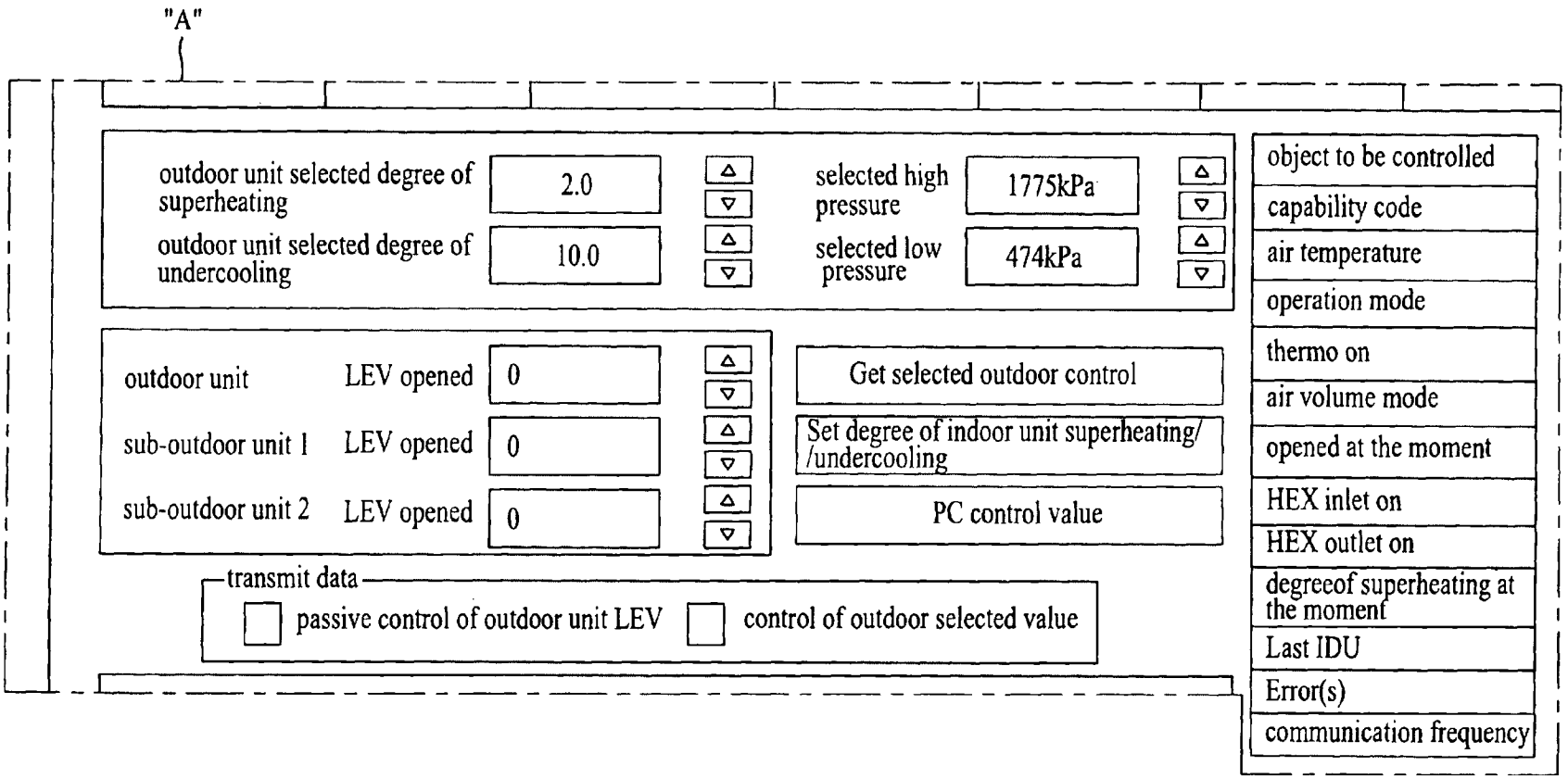

FIG. 4 is a flow chart illustrating a method for monitoring state information in a trial run mode of a multi-airconditioner in accordance with the present invention. FIGS. 5*a*~5*c* show exemplary output images displayed by state monitoring operations of the trial run mode in accordance with the present invention.

Referring to FIG. 4, a plurality of indoor units and a plurality of outdoor units are interconnected via pipe lines and communication lines, such that an installation process of the multi-airconditioning system is performed at step S411. If the installation process of the multi-airconditioning system is completed at step S412, a trial-run-mode controller is connected to the outdoor units, and a specific computer acting as a control input & state display is connected to the trial-run-mode controller at step S413. In this case, the specific computer acting as the control input & state display monitors state information of the trial run mode, enters control signals, and checks the control signals.

The computer executes a trial-run-mode program at step S414. If a user clicks on a start button of the trial run mode at step S415, the trial-run-mode program is driven to automatically control the indoor units, monitors state information, and displays the monitored result on a monitor of the computer at step S416.

An exemplary screen image for displaying the resultant values generated by the execution of the trial-run-mode program is shown in FIG. 5*a*. The exemplary screen image shown in FIG. 5*a* includes a predetermined item for selecting a trial run mode or an indoor-unit control mode. If the trial run mode is selected, a selection window capable of initiating/interrupting the trial run mode.

The above-mentioned screen image shown in FIG. 5*a* is adapted to automatically detect poor installation of the multi-airconditioning system. The screen image of FIG. 5*a* includes a temperature/pressure confirmation window for displaying temperature and pressure information (e.g., a compressor discharge pipe temperature), and a display window for displaying operation states of individual units.

When the poor installation is automatically detected, a microprocessor of the trial-run-mode controller controls operations required for detecting poor installation information, and receives resultant data associated with the control operations via a communication line connected to the outdoor-unit connector.

If a user or operator selects individual ON/OFF functions of the indoor units to perform the above-mentioned trial run mode and to check operation states of the indoor units, the indoor units are separately controlled according to individual ON/OFF functions.

An exemplary screen image for displaying individual ON/OFF control functions of the indoor units is shown in FIG. 5*b*. The exemplary screen image of FIG. 5*b* includes an indoor-unit selection window, capable of selecting/releasing all the indoor units, and selecting individual indoor units independently of each other; an operation/stop selection window of the selected indoor units; an operation mode/ventilation mode selection window; and a selection window for setting a desired temperature.

As described above, the state monitoring method shown in FIG. 4 automatically detects poor installation, and individual ON/OFF control operations of the indoor units. If the operator executes a specific function capable of displaying state information of the indoor units and the outdoor unit, the resultant screen image is shown in FIG. 5*c*. FIG. 5*c* shows temperature information of individual pipes contained in the outdoor units, device state information, and airconditioning cycle information, etc.

The above-mentioned control/monitoring operation is performed to determine whether the multi-airconditioning system is normally installed at step S417. If the multi-airconditioning system is normally installed at step S417, and a corresponding content indicative of the normal installation is displayed on a screen at step S418, such that an installation process of the multi-airconditioning system is completed at step S419.

Otherwise, if the multi-airconditioning system is abnormally installed at step S417 after the above-mentioned control/monitoring operation has been performed, a corresponding content indicative of the abnormal installation is displayed on the screen at step S420.

If the operator desires to view detailed information indicative of a poor installation part, corresponding information indicative of the detailed poor installation information is displayed on the screen at step S421.

The operator checks and repairs the poor installation part at step S422. If the operator re-clicks on the start button of the trial run mode, the trial run mode is automatically performed, such that the poor installation is automatically detected and a control/state monitoring process of the indoor units and the outdoor unit is performed at S423.

The apparatus and method for monitoring state information in a trial run mode of a multi-airconditioning system arranges a trial-run-mode controller between the outdoor unit and a computer capable of receiving a control signal from the operator and displaying information. As a result, the present invention controls operations of the outdoor unit and the indoor units, an indoor-unit pipe temperature, and a room temperature, and monitors operation states of the indoor units, temperatures of individual pipes contained in the outdoor unit, device states, and operation states of the outdoor units, resulting in greater convenience of the operator and an accurate monitoring effect in the trial run mode of the multi-airconditioning system.

As apparent from the above description, the apparatus and method for monitoring state information in the trial run mode of the multi-airconditioning system has the following effects.

Firstly, in the case of the trial run mode executed after the multi-airconditioning system has been installed, the operator connects a trial-run-mode controller to an outdoor unit, instead of controlling individual indoor and outdoor units by allowing the operator to directly move his or her location. Therefore, the multi-airconditioning system performs the trial run mode using the trial-run-mode controller, and automatically detects poor installation, resulting in greater convenience of the operator and reduction of a trial run time.

Secondly, the present invention switches on or off individual indoor units using the trial-run-mode controller connected to the outdoor unit, and monitors operation states of the indoor units, resulting in greater convenience of use and increased operation accuracy of the trial run mode.

Thirdly, the present invention allows the operator to visually check temperatures of individual pipes contained in the outdoor unit, device states, and airconditioning cycle information on a screen using the trial-run-mode controller connected to the outdoor unit, such that it recognizes correct pipe connection states of the indoor and outdoor units, and increases accuracy in controlling cooling/heating operations.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A portable apparatus for monitoring state information in a trial run mode of a multi-airconditioning system in which a plurality of indoor units are connected to an outdoor unit, comprising:

a trial-run-mode controller having a trial-run-mode program for automatically detecting poor installation of the multi-airconditioning system, controlling to power up/down the indoor units at a remote site, and detecting temperature information of individual pipes contained in the outdoor unit and a device state of the outdoor unit, wherein the trial-run mode controller is configured to be easily connected to and disconnected from the outdoor unit; and a control input & state display unit which is connected to the trial-run-mode controller, enters control signals capable of performing control and monitoring operations of the trial run mode executed after the multi-airconditioning system has been installed, and outputs information associated with the control signals, wherein the trial-run-mode controller includes a microprocessor for controlling the indoor and outdoor units, and monitoring the indoor and outdoor units; an outdoor-unit connector configured to be easily connected to and disconnected from the outdoor unit; and a computer connector configured to be easily connected to and disconnected from a computer acting as a terminal capable of entering the control signals and displaying operation states; and wherein the trial-run-mode program is automatically performed after the trial-run-mode controller is connected to the outdoor unit and the control input & state display unit.

2. The portable apparatus according to claim 1, wherein the outdoor unit is connected to a communication module connected to the trial-run-mode controller via the outdoor-unit connector, such that the communication module communicates with the trial-run-mode controller to control operations of the trial run mode and to display operation states of the outdoor unit.

3. The portable apparatus according to claim 1, wherein the microprocessor stores a program for establishing data communication between the outdoor unit and the computer interconnected via the connectors, such that it controls operations generated between the outdoor unit and the computer, and displays operation states generated between the outdoor unit and the computer.

4. The portable apparatus according to claim 1, wherein the trial-run-mode controller stores operation variable values of the multi-airconditioning system during the trial run mode, and stores information indicative of an abnormal installation part.

5. The portable apparatus according to claim 1, wherein the microprocessor stores operation variable values of the multi-airconditioning system during the trial run mode, and stores/outputs information indicative of an abnormal installation part.

* * * * *